US005279014A

United States Patent [19]

Wise et al.

[11] Patent Number: 5,279,014

[45] Date of Patent: Jan. 18, 1994

[54] VEHICLE-MOUNTED BROOM

[75] Inventors: Eugene E. Wise, Bellville; Gordon D. Rinehart, Frederick, both of Ohio

[73] Assignee: Kokosing Construction Company, Inc., Fredericktown, Ohio

[21] Appl. No.: 13,358

[22] Filed: Feb. 4, 1993

[51] Int. Cl.[5] ..... E01H 1/02

[52] U.S. Cl. ..... 15/82; 37/233; 37/234; 37/236

[58] Field of Search ..... 15/79.2, 82-86; 340.3, 340.4; 37/233, 234, 236

[56] References Cited

U.S. PATENT DOCUMENTS

| | | | |
|---|---|---|---|
| 1,904,881 | 4/1933 | Presbrey | 15/82 |
| 3,444,583 | 5/1969 | Laurel | 15/83 |
| 3,624,853 | 12/1971 | Kromer | 15/82 |
| 4,674,143 | 6/1987 | Agergard et al. | 15/83 |
| 4,895,476 | 1/1990 | Vangaeyer | 15/83 |

FOREIGN PATENT DOCUMENTS

| | | | |
|---|---|---|---|
| 154738 | 1/1954 | Australia | 15/82 |

*Primary Examiner*—Edward L. Roberts

*Attorney, Agent, or Firm*—Allen D. Gutchess, Jr.

[57] ABSTRACT

A rotary broom is mounted on the front of a vehicle, such as a tractor. The broom can be pivotally raised and lowered as well as pivoted sideways. The broom is rotatably mounted in bearing blocks which are removably supported by a generally C-shaped frame so that the broom can be removed easily for repair or replacement. A hinged hood is located above the broom and can be open for easy access to the broom. The broom is rotated by a central drive located in a middle portion of the broom so that no drive components extend beyond the sides of the frame, to eliminate interference with curbs and the like. The bearing blocks are mounted on extensions below the frame also to reduce possible interference. The broom assembly also has a hydraulic ram with a floating piston which enables the broom to contact the surface being cleaned with less pressure, causing substantially less wear on the broom bristles.

12 Claims, 4 Drawing Sheets

VEHICLE-MOUNTED BROOM

This invention relates to a rotary broom assembly to be mounted on the front of a tractor or the like.

The rotary broom assembly is primarily used at road construction sites to clean surfaces prior to laying blacktop, for example. The rotary broom assembly includes a mounting bracket which mounts on a lower portion of the tractor and can be designed to fit with any particular tractor design. A first tongue or plate is pivotally mounted on the bracket for pivotal movement in up and down directions, being driven by a first hydraulic ram. A second tongue or plate is pivotally mounted on the first tongue for pivotal sideways movement parallel to the first tongue. This is driven by a second hydraulic ram.

A generally C-shaped broom frame has a central frame member which is affixed to the second tongue and has two forwardly-extending end frame members. The end frame members have downwardly-extending flanges at outer ends thereof with the flanges having notches opening outwardly to receive bearing blocks held in the notches by retaining pins. A rotary broom has a central shaft which has ends received in bearing blocks. With the downwardly-extending flanges for the bearing blocks, the broom assembly will not interfere with curbs and the like near the surface being cleaned by the broom.

The broom is centrally driven for rotation so that no hydraulic motors, etc. extend beyond the ends of the C-shaped frame to further eliminate interference with the curbs, etc. For the central drive,, a hydraulic motor is mounted on a central portion of the center frame member and has a drive sprocket. A driven sprocket is mounted centrally on the broom shaft and is connected to the first drive sprocket by a chain. A chain guard extends around the chain to avoid interference of the chain with the bristles of the broom. The rotary broom assembly also features a hood over the broom which is hinged to the central frame member and can be opened for easy access to the broom. Hold-down latches are mounted on the end frame members to hold the hood in the closed position.

The first hydraulic ram which raises and lowers the broom is designed to enable the broom to float on the surface being cleaned without excess pressure. Bristle wear has thereby been substantially reduced and the bristles also wear more uniformly from end to end of the rotary broom. The hydraulic ram is connected between the mounting bracket and the first tongue. It has a hydraulic cylinder with a rod end and a blind end. A first piston is located in the cylinder and has a piston rod extending from the rod end thereof. A second, floating piston is located in the cylinder between the blind end and the first piston. Hydraulic fluid is supplied by suitable means to the blind end of the cylinder. Hydraulic fluid is also supplied to the cylinder between the floating piston and the first piston through the piston rod which has a passage extending therethrough.

It is, therefore, a principal object of the invention to provide a vehicle-mounted rotary broom having the features and advantages discussed above.

Many other objects and advantages of the invention will be apparent from the following detailed description of a preferred embodiment thereof, reference being made to the accompanying drawings, in which.

Figure 1:
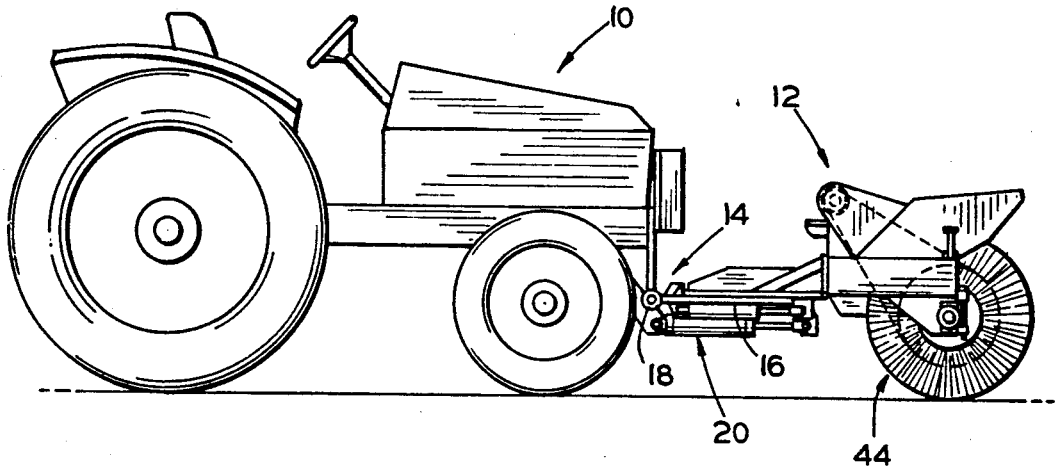
FIG. 1 is a schematic side view in elevation of a tractor and a rotary broom assembly embodying the invention.
Figure 6:
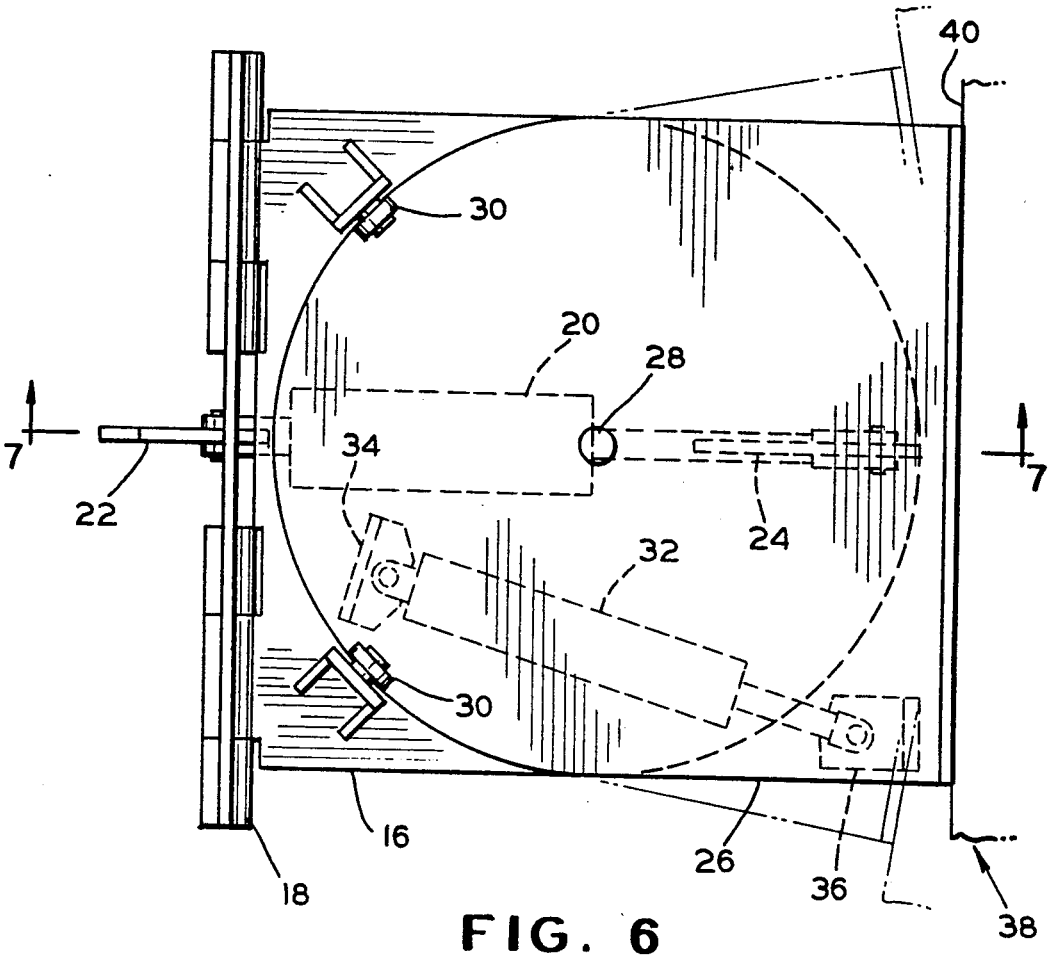
FIG. 6 is a somewhat schematic top view of pivoted tongues connecting a mounting bracket and a broom frame of the broom assembly.

Referring to the drawings, and more particularly to FIG. 1, a vehicle or tractor 10 is shown with a rotary broom assembly 12 mounted on a forward portion thereof. A suitable mounting bracket 14 is affixed to the tractor and can be custom designed to be mounted on any particular tractor. A first pivot plate or tongue 16 (see also FIGS. 6 and 7) is pivotally connected to the bracket by a hinge 18 for pivotal movement in up and down directions. A special hydraulic ram 20, to be discussed subsequently, powers the plate 16, being connected to a flange 22 of the mounting bracket 14 and a flange 24 on the bottom of the plate 16.

Figure 2:
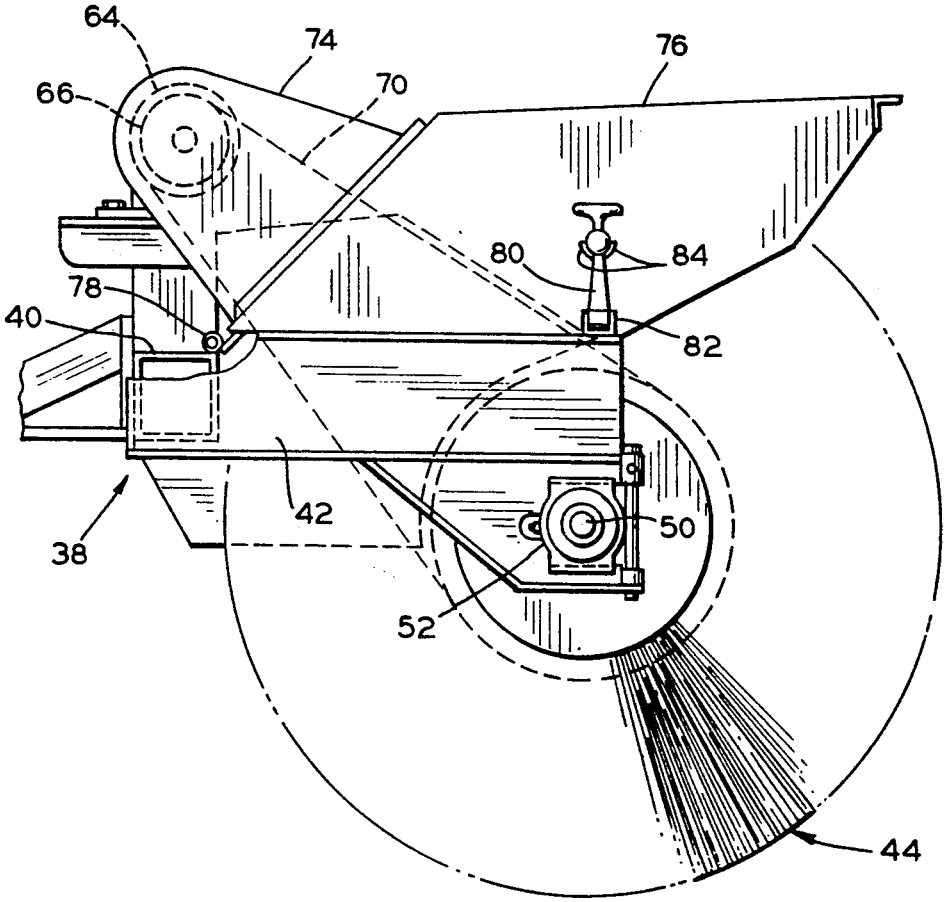
FIG. 2 is an enlarged side view in elevation of part of the rotary broom assembly of FIG. 1.
Figure 3:
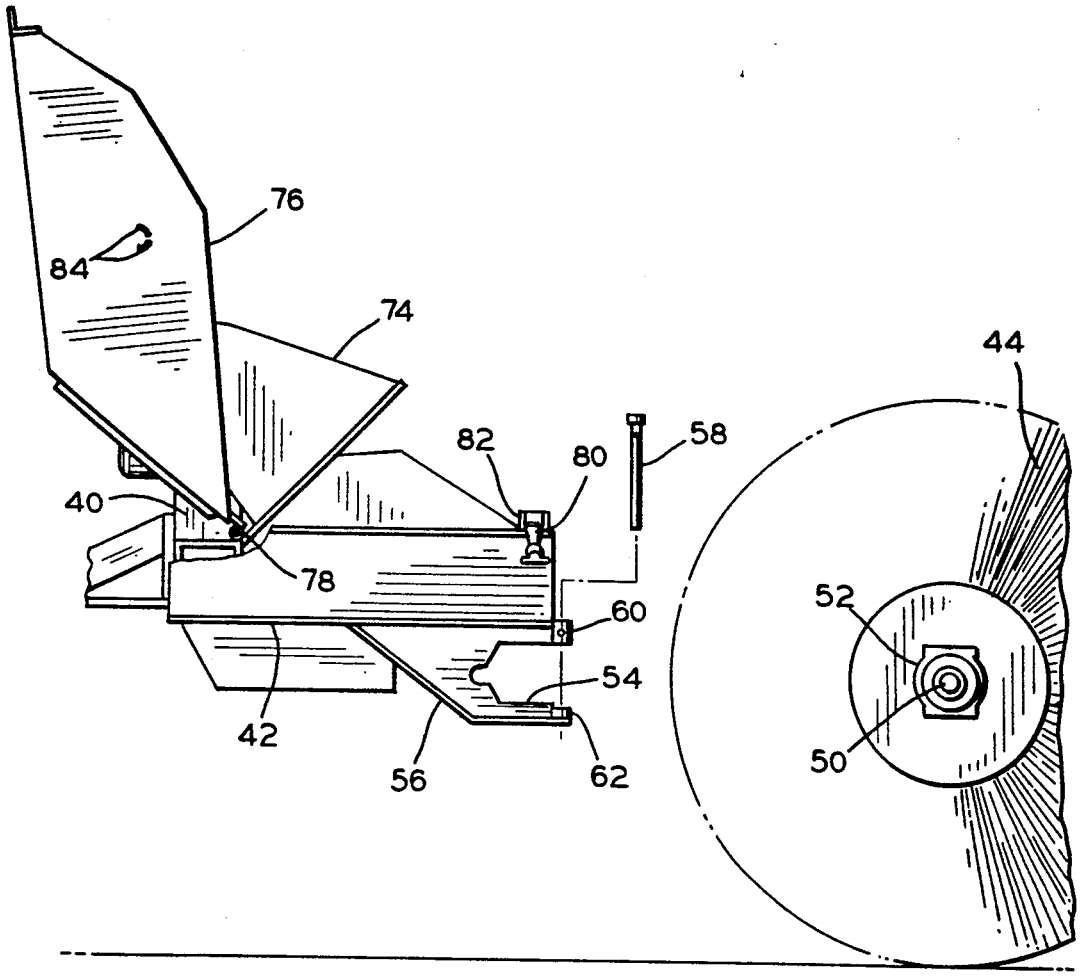
FIG. 3 is a side view in elevation of the components of FIG. 2 shown in different positions.
Figure 4:
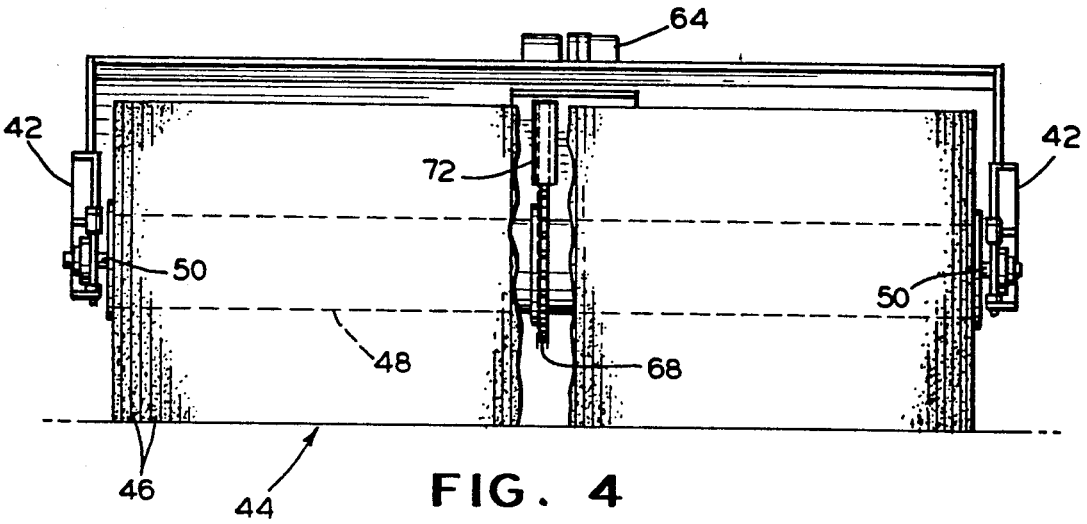
FIG. 4 is a somewhat schematic front view in elevation of the rotary broom and drive.

A second pivot plate or tongue 26 is pivotally supported on top of the plate 16 by a pin 28 and hold-down rollers 30. The plate 26 extends forwardly of the plate 16 and can move pivotally side to side, parallel to the first plate 16. The second plate 26 is powered by a hydraulic ram 32 which is connected to a mounting bracket 34 on the bottom of the plate 16 and to a bracket 36 on the bottom of the second plate 26. The forward edge of the plate 26 is affixed to a C-shaped rotary broom frame 38 and specifically to a central frame member 40 thereof. The frame 38 also has two end frame members 42 (FIGS. 2-4).

A rotary broom 44 (FIG. 4) is rotatably carried by the C-shaped frame 38 and is of a basically known design. It has bristles 46 mounted on a hub 48 with shafts 50 extending beyond the hub 48. The ends of the shafts 50 are rotatably received in bearing blocks 52 (FIGS. 2 and 3). The bearing blocks, in turn, are received in notches 54 of flanges 56 depending from the end frame members 42 of the broom frame 38. The bearing blocks are held in place by pins 58 which extend through tubes 60 and 62 at the ends of the flanges 56. This mounting arrangement for the bearing blocks 52 enables the broom 44 to be readily removed from the frame 38 for replacement or repair. This is accomplished by removing the pins 58 and sliding the bearing blocks 52 out of the notches 54 to separate the frame and broom, as shown in FIG. 3.

By having the notches 54 in the depending flanges 56 rather than in the end frame members 42 themselves, the frame sits higher and there is less chance for the broom to interfere with curbs or the like during the cleaning operation.

Figure 5:
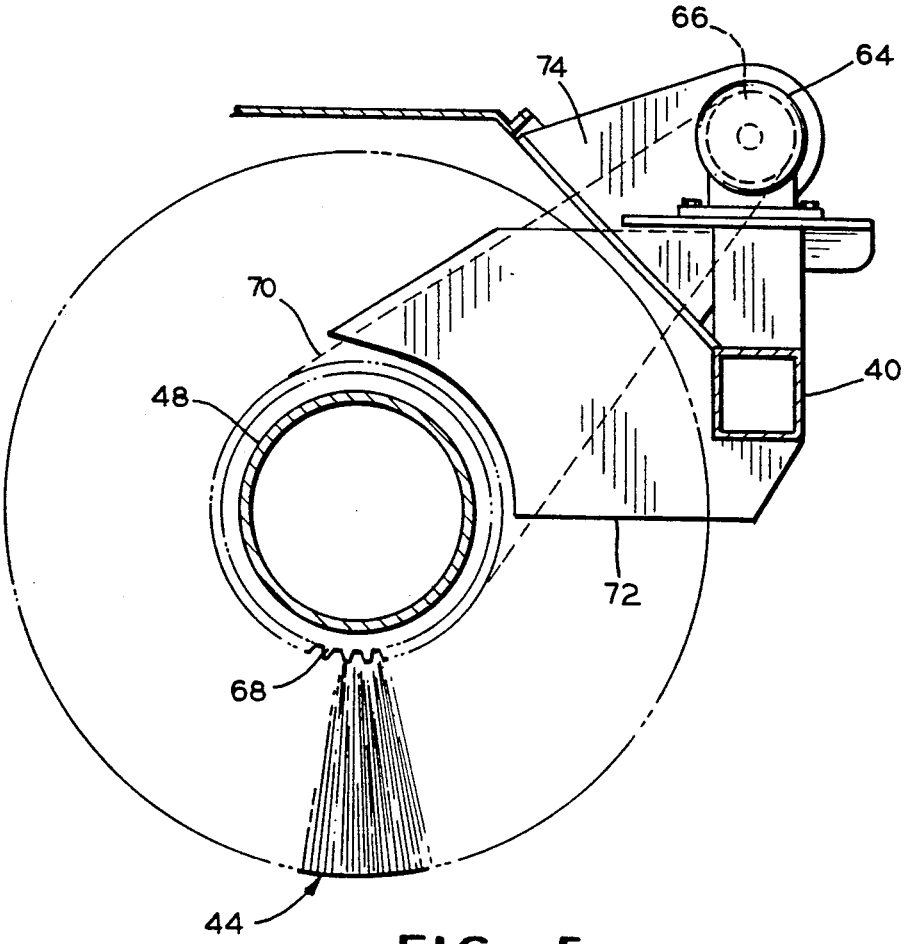
FIG. 5 is a somewhat schematic side view in elevation of the broom drive of FIG. 4.

Rotary brooms are usually driven by a hydraulic motor mounted on one end thereof. This also can cause interference during brushing or cleaning operations. With the broom 44, however, a central drive is provided. For this purpose, a hydraulic motor 64 (FIGS. 2, 4 and 5) is mounted on the central frame member 40 and has a toothed member or drive sprocket 66. A large, driven toothed member or sprocket 68 is mounted centrally on the hub 48 and is connected to the drive sprocket 66 by a chain 70. A chain guard 72 (FIG. 5) extends around the chain 70 and toward the driven sprocket 68 to prevent interference between the bristles 46 and the chain 70. A safety chain guard 74 also is located above the broom 44.

To provide access to the rotary broom 44 for replacement or repair, a binged hood 76 (FIGS. 2 and 3) is located above the broom. The hood 76 is connected by a hinge 78 to the central frame member 40 and has an opening (not shown) to clear the hydraulic motor 64, the drive sprocket 66, and the safety guard 74 when the hood is raised. Rubber hold-down latches 80 are pivotally mounted on ends of the end frame members 42 by brackets 82. The latches have upper enlarged portions which are received in curved flanges 84 on the ends of the hood 76 when the hood is lowered, to hold the hood in place.

Figure 8:
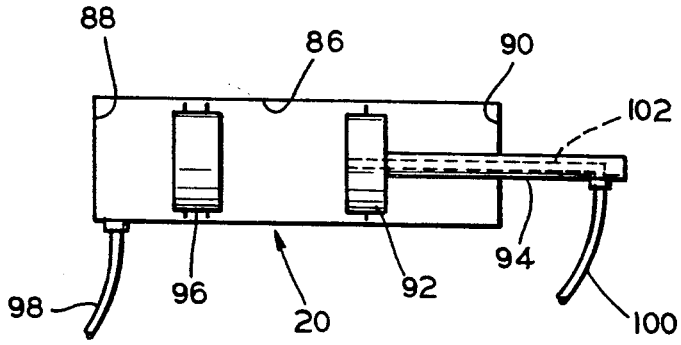
FIG. 8 is a schematic view of a hydraulic ram used with the rotary broom assembly.
Figure 7:
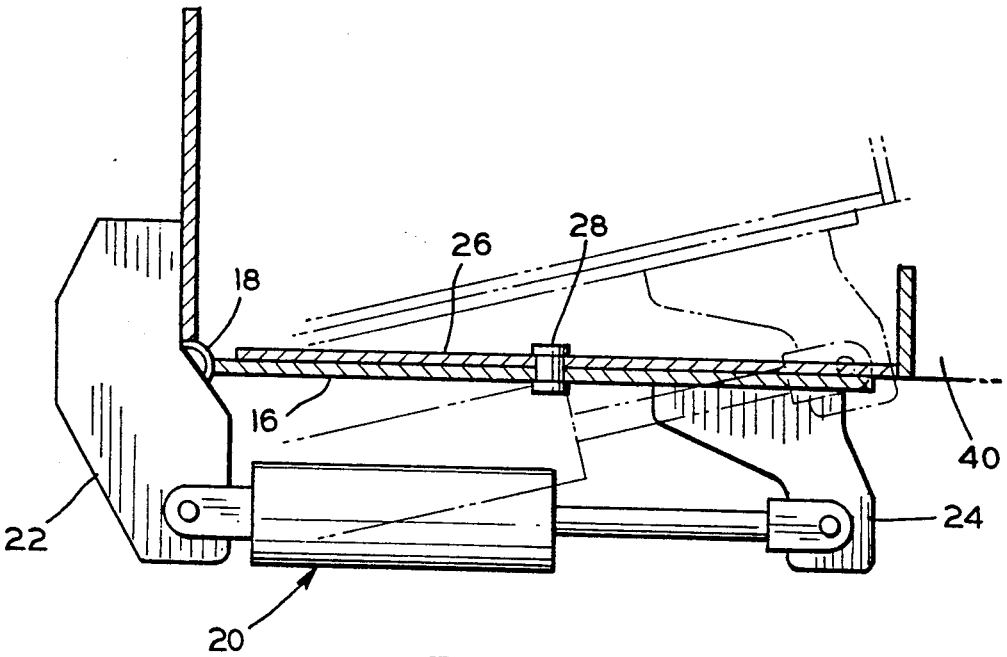
FIG. 7 is a somewhat schematic view taken along the line 7—7 of FIG. 6.

The special hydraulic ram 20 which pivots the first plate 16 up and down to raise and lower the broom frame 38 and the broom 44 is schematically shown in FIG. 8. The ram includes a hydraulic cylinder 86 having a blind end 88 and a rod end 90. A first piston 92 is located in the cylinder and has a piston rod 94 extending therefrom for connection with the flange 24 (FIG. 7). A second, floating piston 96 is located in the cylinder 86 between the piston 92 and the blind end 88 of the cylinder. A hydraulic line 98 communicates with the blind end of the cylinder. A second hydraulic line 100 communicates with a passage 102 in the piston rod 94 which communicates with the cylinder 86 between the first piston 92 and the floating piston 96. This arrangement enables the ram 20 to raise and lower the broom 44 yet when the broom is in contact with the surface being cleaned, it floats so as to exert less pressure on the bristles and to accommodate irregularities in the surface. Bristle wear is thereby significantly reduced and the bristles also wear more evenly over the length of the broom.

Various modifications of the above-described embodiment of the invention will be apparent to those skilled in the art and it is to be understood that such modifications can be made without departing from the scope of the invention, if they are within the spirit and the tenor of the accompanying claims.

We claim:

1. A rotary broom assembly to be mounted on a forward portion of a tractor or the like, said assembly comprising bracket means for mounting the assembly on the forward portion, a first plate pivotally mounted on said bracket means for pivotal movement in up and down directions, a second plate pivotally connected to said first plate for pivotal sideways movement parallel to said first plate, a generally C-shaped frame having a central frame member affixed to said second plate and two outwardly-extending end frame members, said end frame members having downwardly-extending flanges at outer ends with said flanges having notches opening outwardly, said flanges having removable retaining pins for closing off said notches, bearing blocks in said notches and held by said retaining pins, a broom having central shaft means rotatably supported by said bearing blocks, a hood hinged to said central frame member, latch means on said end frame members for holding said hood in a closed position, hydraulic drive means including a drive sprocket mounted on a central portion of said central frame member, a driven sprocket centrally mounted on said shaft means, a chain connecting said drive and driven sprockets, a hydraulic ram connected between said bracket means and said first plate to pivotally raise and lower said broom, said ram having a cylinder with a rod end and a blind end, a first piston in said cylinder having a piston rod extending from the rod end of said cylinder, a second, floating piston in said cylinder between the blind end thereof and said first piston, means for supplying hydraulic fluid to the blind end of said cylinder, and means for supplying hydraulic fluid to said cylinder between said pistons through said piston rod.

2. A rotary broom assembly to be mounted on a forward portion of a vehicle, said assembly comprising bracket means for mounting the assembly on the forward portion, a first plate pivotally mounted on said bracket means for pivotal movement in up and down directions, a broom frame having a central frame member and two outwardly-extending end frame members, means connecting said central frame member to said first plate, bearing blocks supported by said end frame members, a broom having central shaft means rotatably supported by said bearing blocks, drive means including a drive sprocket mounted on a central portion of said central frame member, a driven sprocket centrally mounted on said shaft means, a chain connecting said drive and driven sprockets, and a hydraulic ram connected between said bracket means and said first plate to pivotally raise and lower said broom.

3. A rotary broom assembly according to claim 2 wherein said hydraulic ram has a cylinder with a rod end and a blind end, a first piston in said cylinder having a piston rod extending from the rod end of said cylinder, a second, floating piston in said cylinder between the blind end thereof and said first piston, means for supplying hydraulic fluid to the blind end of said cylinder, and means for supplying hydraulic fluid to said cylinder between said pistons through said piston rod.

4. A rotary broom assembly according to claim 2 wherein said end frame members have downwardly-extending flanges, bearing blocks held by said downwardly-extending flanges, and said central shaft means being rotatably supported by said bearing blocks.

5. A rotary broom assembly according to claim 2 wherein a hood is hinged to said central frame member, and latch means for holding said hood in a closed position above said broom.

6. A rotary broom assembly to be mounted on a forward portion of a tractor or the like, said assembly comprising bracket means for mounting the assembly on the forward portion, a first plate pivotally mounted on said bracket means for pivotal movement in up and down directions, a generally C-shaped broom frame having a central frame member and two outwardly-extending end frame members, means connecting said broom frame to said first plate, a broom rotatably supported by said end frame members, a hydraulic ram connected between said bracket means and said first plate to pivotally raise and lower said broom, said ram having a cylinder with a rod end and a blind end, a first piston in said cylinder having a piston rod extending from the rod end of said cylinder, a second, floating piston in said cylinder between the blind end thereof and said first piston, means for supplying hydraulic fluid to the blind end of said cylinder, and means for supplying hydraulic fluid to said cylinder between said pistons through said piston rod.

7. A rotary broom assembly according to claim 6 wherein said end frame members have downwardly-extending flanges, bearing blocks held by said downwardly-extending flanges, and said broom being rotatably supported by said bearing blocks.

8. A rotary broom assembly according to claim 6 wherein a hood is hinged to said central frame member, and latch means for holding said hood in a closed position above said broom.

9. A rotary broom assembly to be mounted on a forward portion of a tractor or the like, said assembly comprising bracket means for mounting the assembly on the forward portion, a broom frame having a central frame member pivotally connected to said bracket means-, said broom frame also having two outwardly-extending end frame members, a broom having central shaft means rotatably supported by said end frame members, hydraulic drive means including a drive sprocket mounted on a central portion of said central frame member, a driven sprocket centrally mounted on said shaft means, and a chain connecting said drive and driven sprockets.

10. A rotary broom assembly according to claim 9 wherein said end frame members have downwardly-extending flanges, bearing blocks held by said downwardly-extending flanges, and said central shaft means being rotatably supported by said bearing blocks.

11. A rotary broom assembly according to claim 10 wherein said downwardly-extending flanges have notches which open outwardly, said flanges having removable retaining pins for closing off said notches,, said bearing blocks being held in said notches by said retaining pins.

12. A rotary broom assembly according to claim 9 wherein a hood is hinged to said central frame member, and latch means for holding said hood in a closed position above said broom.

* * * * *

UNITED STATES PATENT AND TRADEMARK OFFICE

CERTIFICATE OF CORRECTION

PATENT NO. : 5,279,014

DATED : January 18, 1994

INVENTOR(S) : Eugene E. Wise et al

It is certified that error appears in the above-indentified patent and that said Letters Patent is hereby corrected as shown below:

Column 1, line 33, after "drive" delete one ","
Column 3, line 11, change "binged" to --hinged--.
Column 5, Claim 9, line 6, after "means" delete "-".
Column 6, Claim 11, line 4, after "notches' delete one ",".

Signed and Sealed this

Twenty-first Day of June, 1994

*Attest:*

Bruce Lehman

BRUCE LEHMAN

*Attesting Officer*

*Commissioner of Patents and Trademarks*